US006041206A

United States Patent [19]

Park

[11] Patent Number: 6,041,206

[45] Date of Patent: Mar. 21, 2000

[54] SQUEEZE ROLLER ELEVATING APPARATUS OF LIQUID ELECTROPHOTOGRAPHIC PRINTER

[75] Inventor: woo-yong Park, Suwon, Rep. of Korea

[73] Assignee: Samsung Electronics Co., Ltd., Kyungki-do, Rep. of Korea

[21] Appl. No.: 09/307,029

[22] Filed: May 7, 1999

[30] Foreign Application Priority Data

May 8, 1998 [KR] Rep. of Korea ..... 98-16505
Sep. 15, 1998 [KR] Rep. of Korea ..... 98-37925

[51] Int. Cl.[7] ..... G03G 15/10

[52] U.S. Cl. ..... 399/249

[58] Field of Search ..... 399/237, 249

[56] References Cited

U.S. PATENT DOCUMENTS 5,442,426 8/1995 Yamamura et al. ..... 399/249 X
5,521,685 5/1996 Barnes et al. ..... 399/249
5,608,503 3/1997 Fujiwara et al. ..... 399/237 X
5,907,754 5/1999 Kim et al. ..... 399/249 X

*Primary Examiner*—Fred L. Braun

*Attorney, Agent, or Firm*—Sughrue, Mion, Zinn, Macpeak & Seas, PLLC

[57] ABSTRACT

A squeeze roller elevating apparatus of a liquid electrophotographic printer for selectively pressing a photoreceptor belt, which is installed at a belt frame for circulation, by elevating a squeeze roller. The apparatus includes a housing fixed at the belt frame, a squeeze frame installed in the housing and operative to elevatingly support the squeeze roller, a first elevating member installed at the squeeze frame for elevating movement, a second elevating member installed at the squeeze frame for elevating movement by being interlocked with the elevating movement of the first elevating member and moving the squeeze frame upward so that the squeeze roller presses the photoreceptor belt while ascending, a first spring coupling the first elevating member and the second elevating member to be interlocked with one another, a second spring coupling the second elevating member and the squeeze frame to be interlocked with one another, and an elevator which elevates the first elevating member. Thus, since the print mode, the "drip-line" mode, and the stand-by mode are performed as the squeeze roller installed at the squeeze frame is elevated, a reactionary force generated when the photoreceptor belt is pressed can be prevented from being transferred to the main frame.

2 Claims, 10 Drawing Sheets

SQUEEZE ROLLER ELEVATING APPARATUS OF LIQUID ELECTROPHOTOGRAPHIC PRINTER

BACKGROUND OF THE INVENTION

1. Field of the Invention

The present invention relates to a squeeze roller elevating apparatus of a liquid electrophotographic printer.

2. Description of the Related Art

In a liquid electrophotographic printer, a developing unit for developing an electrostatic latent image formed on a photoreceptor belt is provided. The developing unit, as shown in FIG. 1, includes a developing roller 13 for developing an electrostatic latent image by supplying a developer 1 which is a mixture of powdered toner and a liquid carrier to the photoreceptor belt, and a squeeze roller 11 for removing excess developer from the photoreceptor belt 10.

The squeeze roller 11 presses the photoreceptor belt 10 against a backup roller 12 in a print mode to remove the extra developer. In a stand-by mode after printing, the squeeze roller 11 is separated from the photoreceptor belt 10 and a pressing force is removed. There is a "drip-line" removing mode for removing a "drip-line" between the print mode and the stand-by mode. A "drip-line" is generated when the developer remains in a portion where the squeeze roller 11 and the photoreceptor belt 10 closely contact one another during printing. In the drip-line removing mode, a pressing force of the squeeze roller 11 to the photoreceptor belt 10 is slightly reduced and the squeeze roller 11 is rotated opposite the circulation direction of the photoreceptor belt 10 so that the remaining developer is detached to the bottom.

For the above operation, a liquid electrophotographic printer is provided with a squeeze roller elevating apparatus so that the squeeze roller 11 is separated from the photoreceptor belt 10, in the stand-by mode, and is elevated and pressed to the photoreceptor belt 10 in the print mode. Also, in the "drip-line" removing mode, a pressing force can be reduced.

The structure of a conventional squeeze roller elevating apparatus is shown in FIG. 2. A squeeze frame 20 having a squeeze roller 11 is installed at a main frame 40 to be capable of elevating. The squeeze frame 20 is elevated by a cam 22 rotated by a driving motor (not shown) and thus the squeeze roller 11 can be elevated. Reference numeral 30 refers to a belt frame which supports the photoreceptor belt 10 so as to not deviate from a regular circulation path.

In the squeeze roller elevating apparatus having the above structure, when the squeeze roller 11 is lifted to press the photoreceptor belt against the backup roller 12, a repulsive or reactionary force to the pressing force is directly transferred to the main frame 40, which becomes a problem. That is, since the reactionary force to the force pressing the photoreceptor belt 10 is applied to the main frame 40 supporting the squeeze frame 20, a distortion transformation can be generated to the main frame 40 when printing continues for a long time. Thus, a squeeze roller elevating apparatus which can best prevent the transfer of such a reactionary force applied to the main frame 40 is required.

SUMMARY OF THE INVENTION

To solve the above problem, it is an object of the present invention to provide a squeeze roller elevating apparatus of a liquid electrophotographic printer having an improved structure of preventing transformation of a main frame due to a reactionary force generated when a squeeze roller presses a photoreceptor belt.

Accordingly, to achieve the above object, there is provided a squeeze roller elevating apparatus of a liquid electrophotographic printer for selectively pressing a photoreceptor belt, which is installed at a belt frame for circulation, by elevating a squeeze roller. The apparatus includes a housing fixed at the belt frame, a squeeze frame installed in the housing and operative to elevatingly support the squeeze roller, a first elevating member installed at the squeeze frame for elevating movement, a second elevating member installed at the squeeze frame for elevating movement by being interlocked with the elevating movement of the first elevating member and moving the squeeze frame upward so that the squeeze roller presses the photoreceptor belt while ascending, a first spring coupling the first elevating member and the second elevating member to be interlocked with one another, a second spring coupling the second elevating member and the squeeze frame to be interlocked with one another, and an elevator which elevates the first elevating member.

It is preferable in the present invention that the elevator comprises a driving motor, a cam member having a cam groove formed therein and rotated by the driving motor, which is installed at a shaft extended from the belt frame to pass through the inside of the housing, and a cam protrusion formed at the first elevating member and slidably inserted in the cam.

BRIEF DESCRIPTION OF THE DRAWINGS

The above object and advantages of the present invention will become more apparent by describing in detail preferred embodiments thereof with reference to the accompanying drawings, in which.

DETAILED DESCRIPTION OF THE PREFERRED EMBODIMENTS

FIGS. 3 through 8 show a preferred embodiment of the squeeze roller elevating apparatus according to the present invention.

Figure 3:
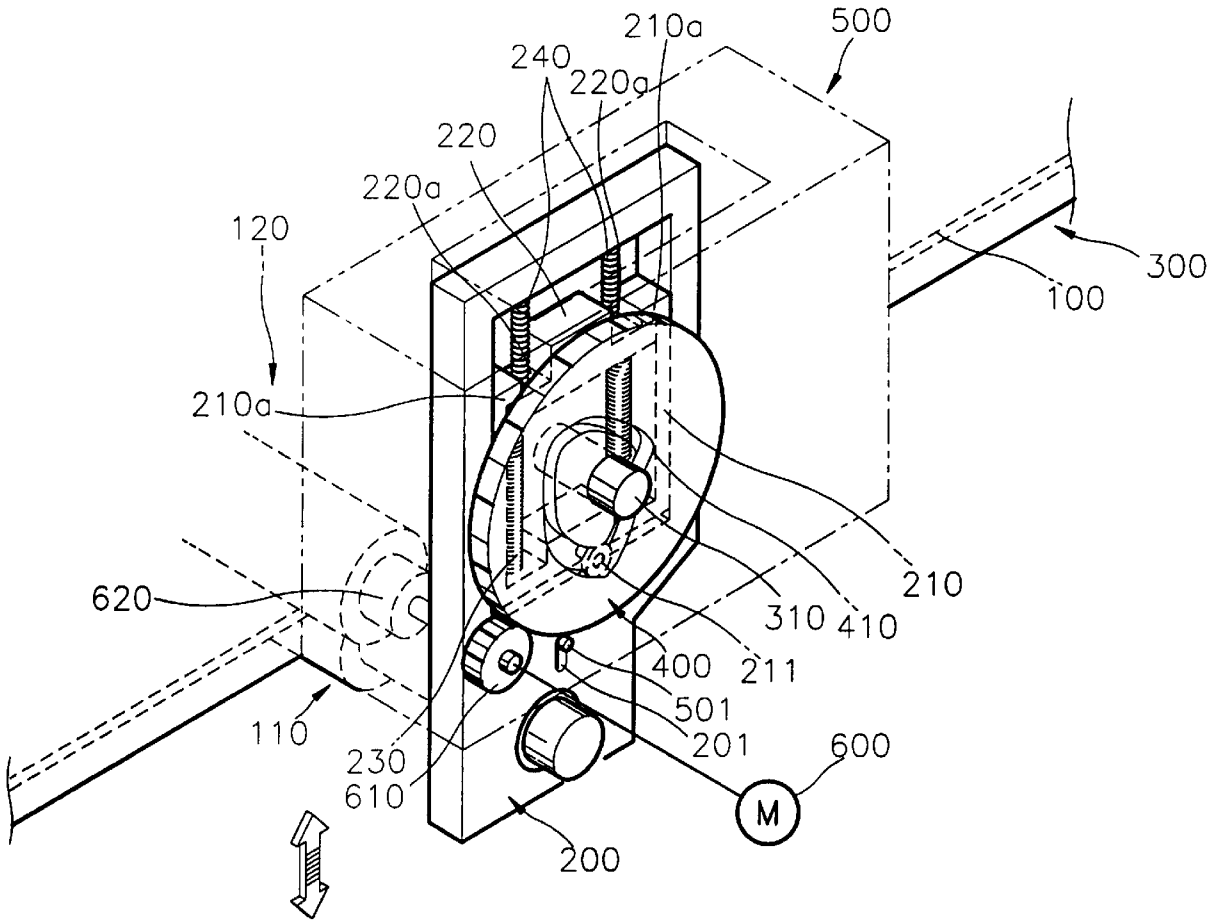
FIG. 3 is a perspective view showing a squeeze roller elevating apparatus according to a preferred embodiment of the present invention.
Figure 4A:
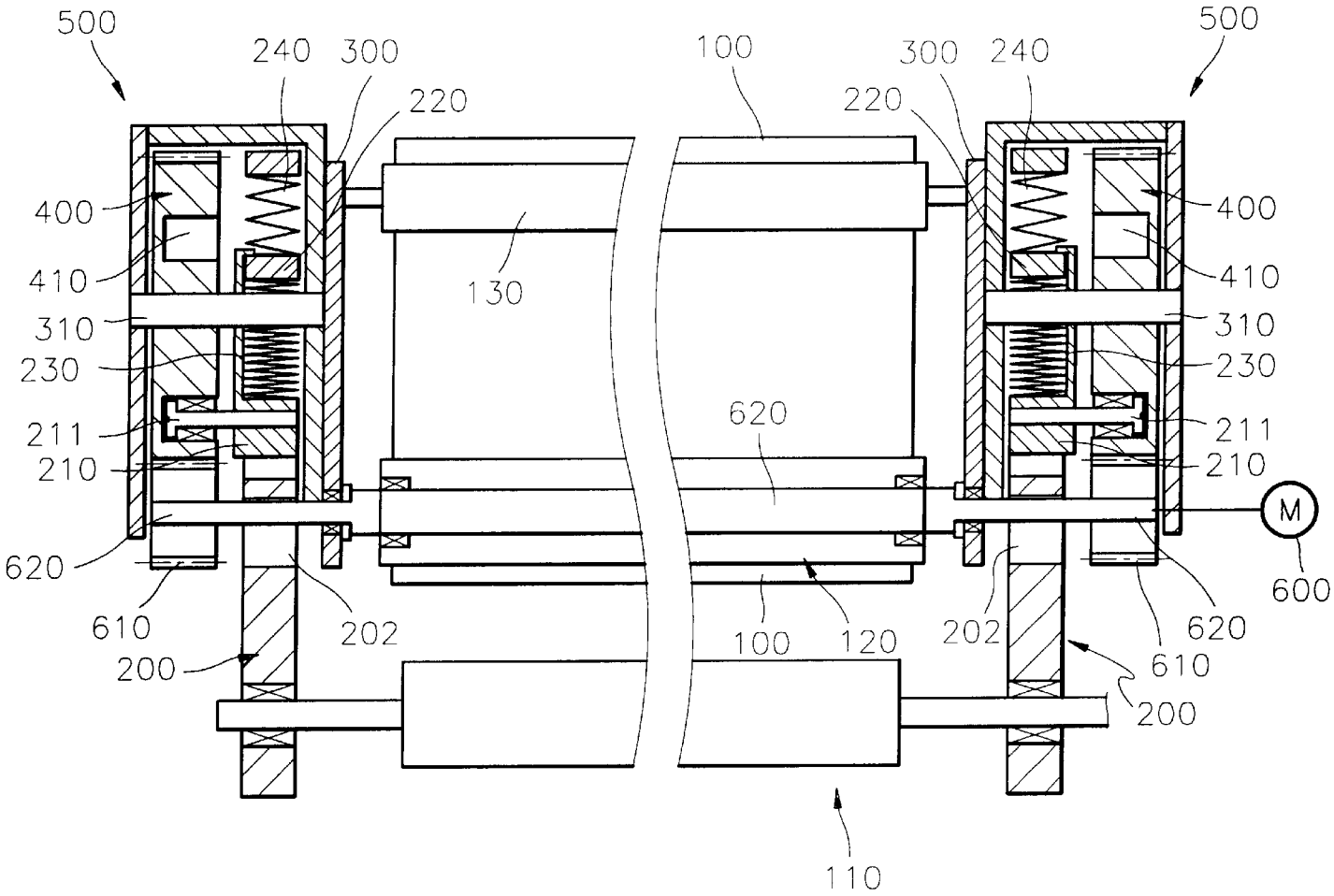
FIG. 4A is a sectional view showing the squeeze roller elevating apparatus shown in FIG. 3.

Referring to FIGS. 3 and 4A, a pair of housings 500 for supporting a photoreceptor belt 100 so as to not deviate from a circulation path are respectively installed at both sides of a belt frame 300. A squeeze frame 200 for supporting the squeeze roller 110 is installed in the housing 500 for elevating movement. First and second elevating members 210 and 220 are installed for elevating movement in the squeeze frame 200.

First and second interlocking devices 210*a* and 220*a* are provided at the first and second elevating members 210 and 220, respectively. The second elevating ember 220 is biased upward by a pair of first springs 230 so that the second interlocking portion 220*a* can contact the first interlocking portion 210*a* of the first elevating member 210. Also, the second elevating member 220 is connected to the squeeze frame 200 by a pair of second springs 240. Accordingly, when the first elevating member 210 is moved upward, the second elevating member 220 also ascends by an elastic force of the first springs 230. Concurrently, as the second elevating member 220 ascends, the squeeze frame 200 connected to the second elevating member 220 by the second springs 240 also ascends.

An elevator for elevating the first elevating member 210 includes a driving motor 600, a cam member 400 engaged with a relay gear 610 coupled to the driving motor 600, and a cam protrusion 211 formed on the first elevating member 210 to be inserted into a cam groove 410 formed in the cam member 400.

The cam member 400, which is supported by a shaft 310 extended through the housing 500 from the belt frame 300, moves the first elevating member 210 upward as it rotates by the driving motor 600. A rotation shaft 620 of a backup roller 120 facing the squeeze roller 110 with respect to the photoreceptor belt 100 extends to the inside of the housing 500 and passes through a slot 202 formed in the squeeze frame 200 so as to permit the squeeze frame 200 to move up and down with respect to the shaft 620, and the relay gear 610 is coupled to an end portion of the rotation shaft 620. Thus, the relay gears 610 positioned at both sides of the belt frame 300 can be rotated by a single driving motor 600.

Figure 4B:
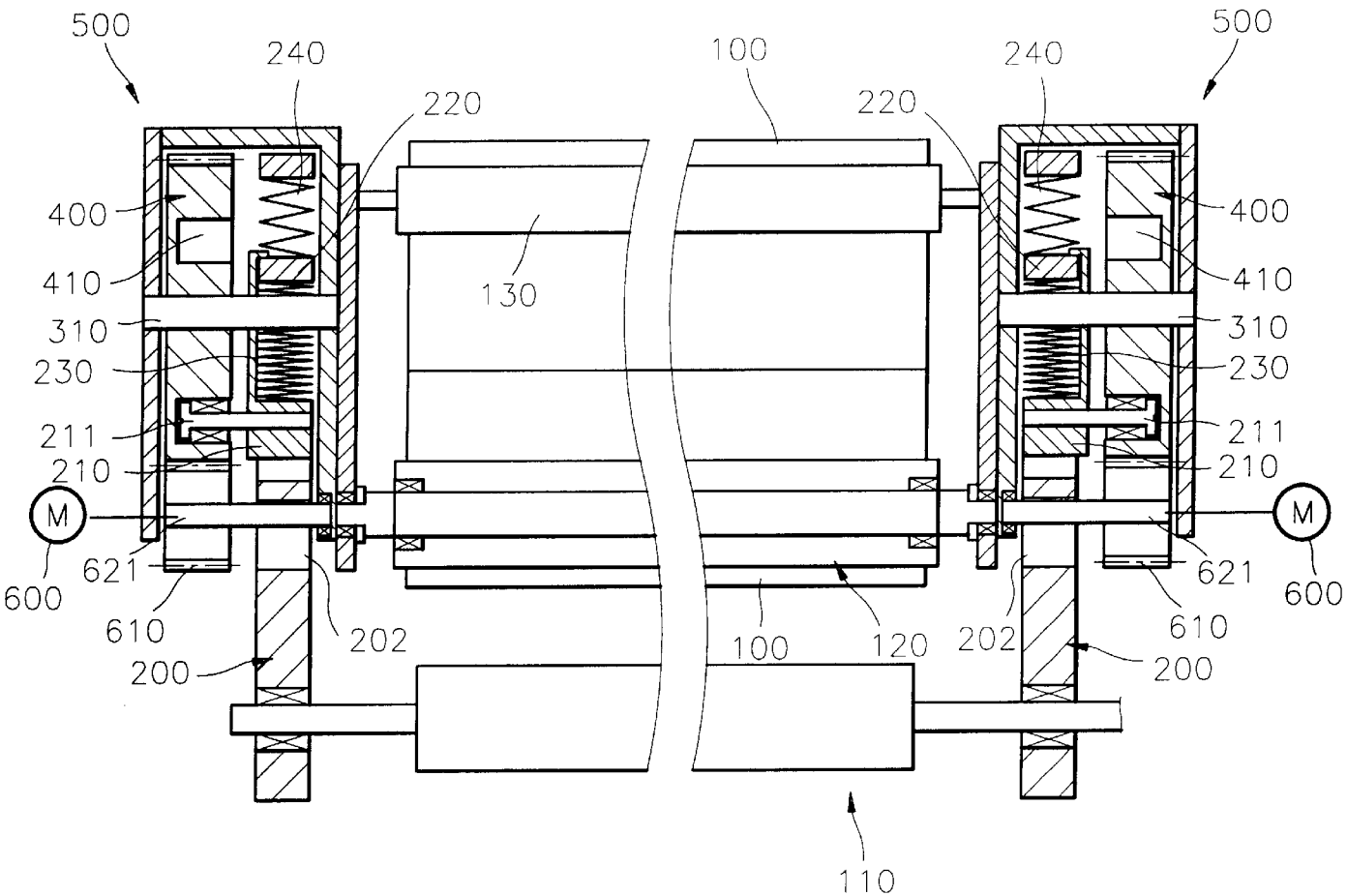
FIG. 4B is a view showing another example of a relay gear.

Alternatively, as shown in FIG. 4B, a support shaft 621 rotated by the respective driving motors 600 is additionally installed at each housing 500 and the relay gears 610 are installed respectively on the shafts 621. The support shafts 621 are rotatably supported at the ends thereof in the respective housings 500 as shown in FIG. 4B. A slot 202 is again provided in the squeeze frame 200 to permit the squeeze frame 200 to move up and down with respect to the corresponding shaft 621.

In FIGS. 3 and 4A, reference numeral 130 indicates a guide roller for guiding circulation of the photoreceptor belt 100 and reference numeral 501 indicates an elevation guide protrusion formed from the housing 500 to be inserted in a slot 201 formed in the squeeze frame 200.

Figure 5:
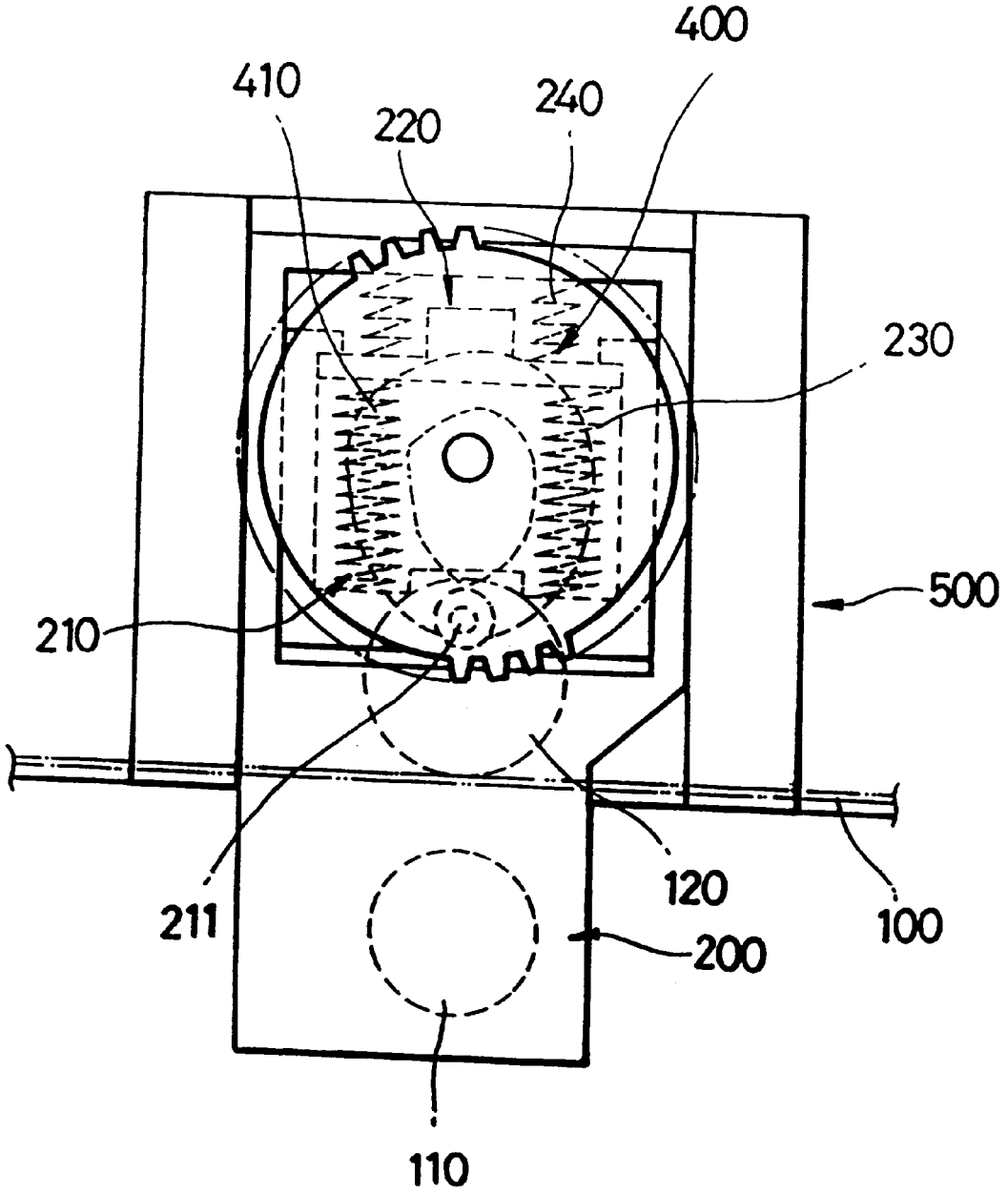
FIGS. 5 through 8 are views for explaining the operation of the squeeze roller elevating apparatus shown in FIG. 3.

The operation of the squeeze roller elevating apparatus having the above structure is as follows. First, in a printing stand-by mode, as shown in FIG. 5, the squeeze roller 110 is separated from the backup roller 120 in a state in which the squeeze frame 200 is lowered. Here, the cam protrusion 211 of the first elevating member 210 is positioned at the lowest position of the cam groove 410 formed on the cam member 400.

Figure 6:
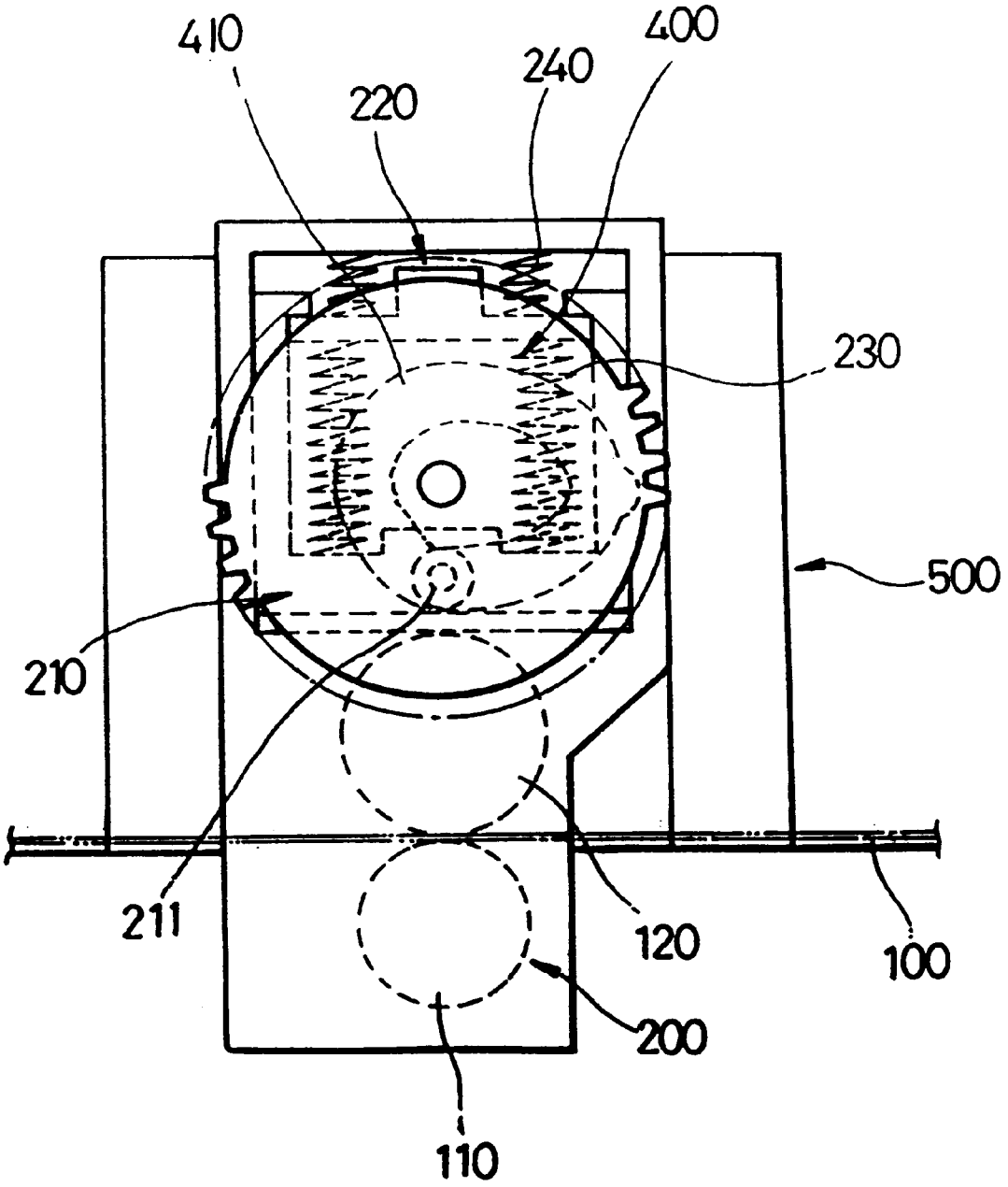

When the cam member 400 is rotated counterclockwise by the driving motor 600, as shown in FIG. 6, the cam protrusion 211 moves along the cam groove 410 and the first elevating member 210 ascends. At this stage, the second elevating member 220 coupled to the first elevating member 210 ascends by an elastic force of the first springs 230 and simultaneously the squeeze frame 200 ascends by an elastic force of the second springs 240. Thus, the squeeze roller 110 supported by the squeeze frame 200 closely contacts the backup roller 120 and presses the photoreceptor belt 100.

Figure 7:
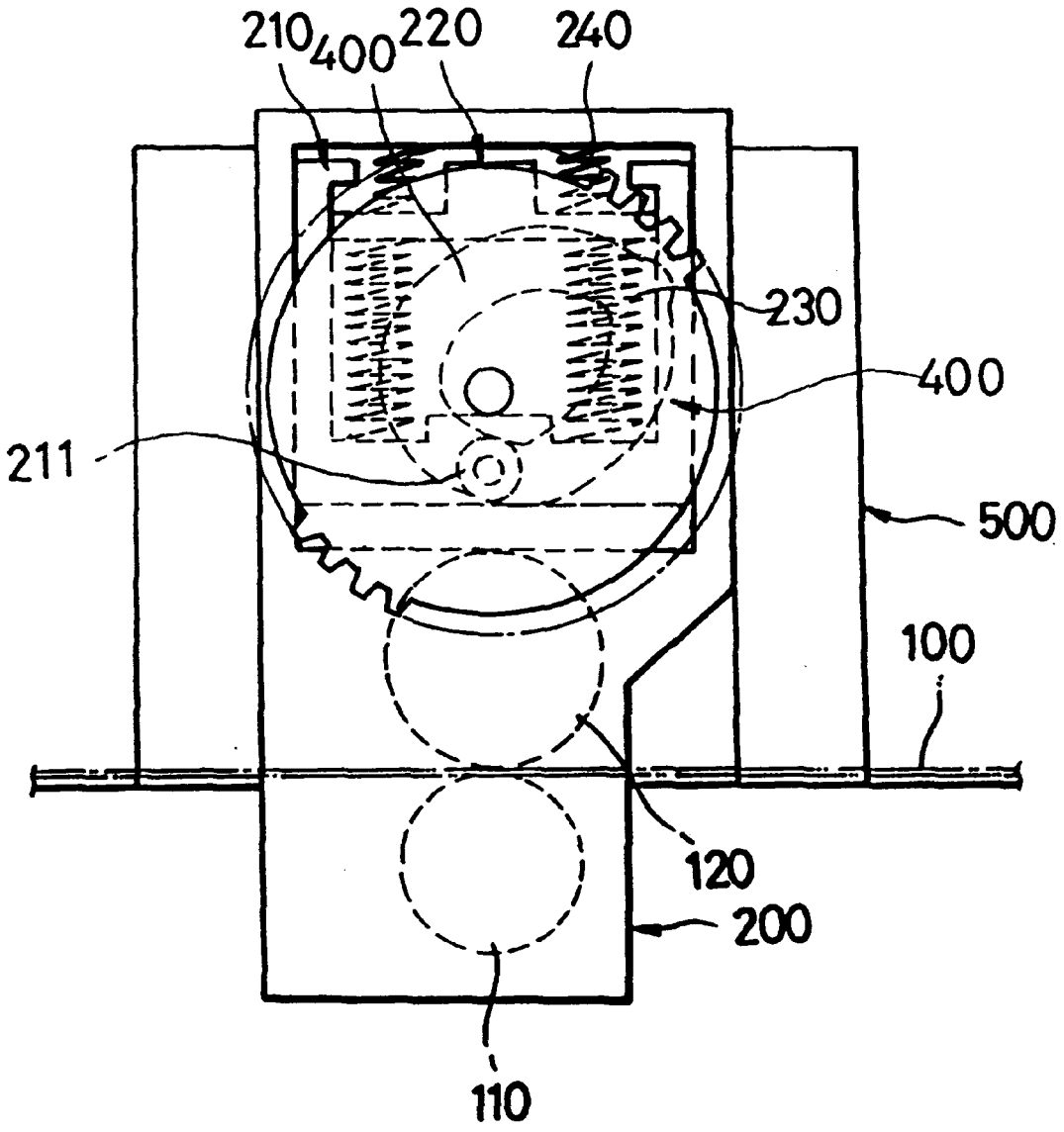

Under theses circumstances, when the cam member 400 further rotates counterclockwise, as shown in FIG. 7, the cam protrusion 211 moves along the cam groove 410 and the first elevating member 210 ascends further. Thus, a pressing force by the squeeze roller 110 to the photoreceptor belt 100 increases further. As printing proceeds in such a state, the squeeze roller 110 closely presses the photoreceptor belt 100 so that a liquid carrier on the photoreceptor belt 100 can be removed therefrom.

Figure 8:
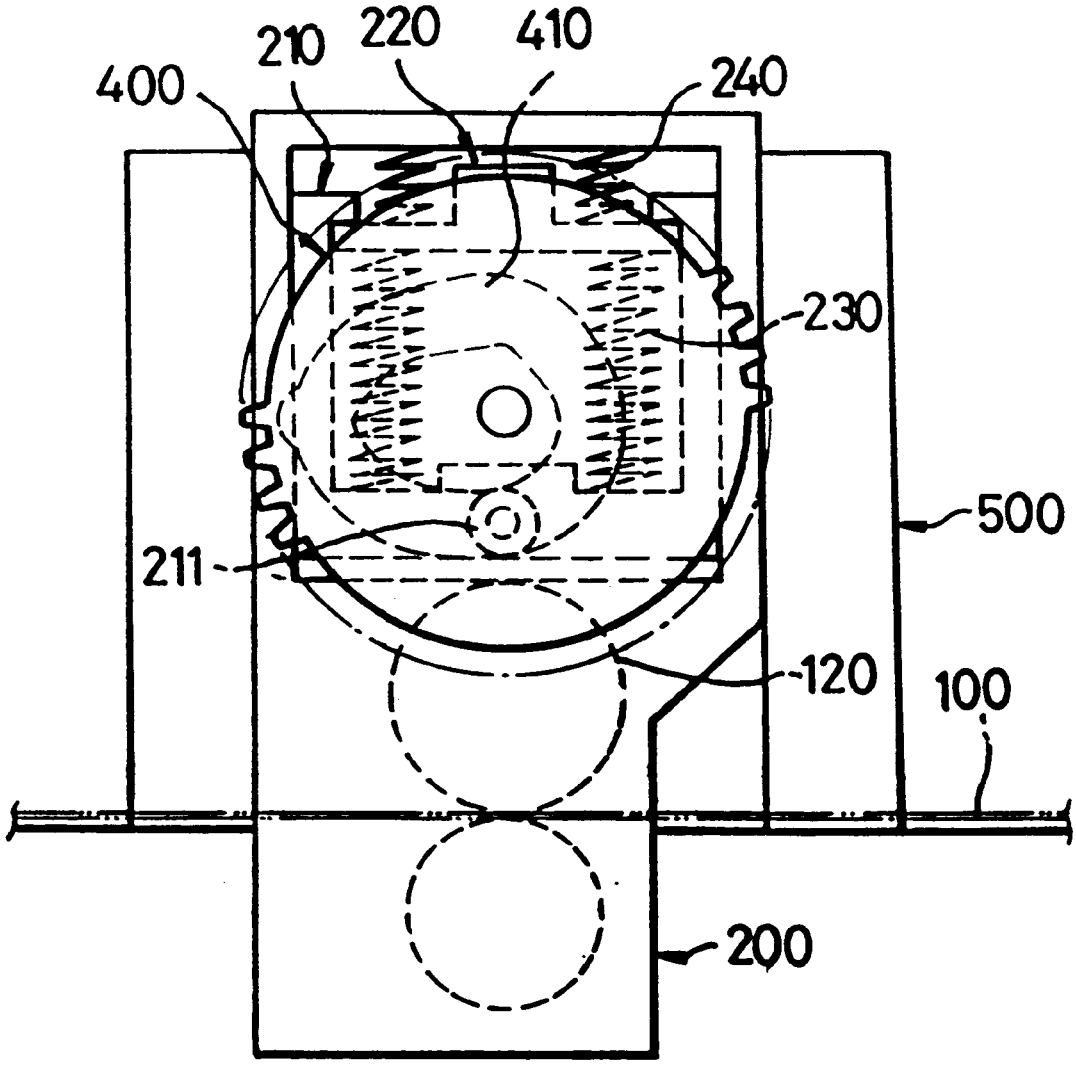

In the "drip-line" removing mode, as shown in FIG. 8, the cam member 400 is further rotated counterclockwise to lower the cam protrusion from the position in FIG. 7. Accordingly, as a state in which the squeeze roller 110 and the backup roller 120 are in close contact with one another is maintained, the pressing force to the photoreceptor belt 100 only is reduced by about 1/10 that of the printing mode in FIG. 7. Under these circumstances, the squeeze roller 110 is rotated in the opposite direction to remove the "drip-line".

Next, when printing is completed and the squeeze roller 110 is to be separated from the photoreceptor belt 100, the cam member 400 is further rotated counterclockwise so that the cam protrusion 211 returns to the initial position shown in FIG. 5. Thus, the first elevating member 210, the second elevating member 220, and the squeeze frame 200 all descend so that the squeeze roller 110 is separated from the photoreceptor belt 100.

Figure 9:
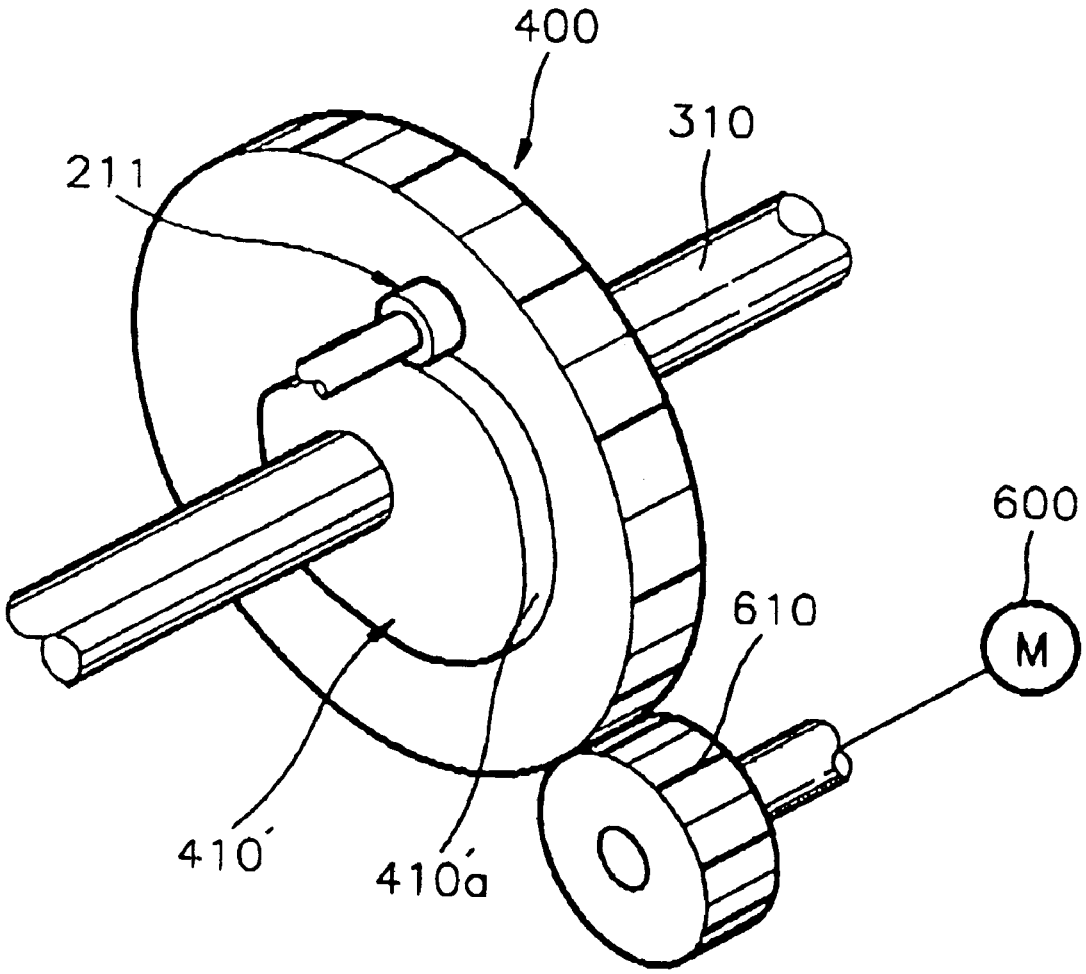
FIG. 9 is a perspective view showing a squeeze roller elevating apparatus according to another preferred embodiment of the present invention.

In the present embodiment, the cam protrusion 211 is interlocked by being inserted in the cam groove 410 formed in the cam member 400. However, it is possible that the cam protrusion 211 can elevate along an outer circumferential surface 410'a by adopting a cam portion 410' where the outer circumferential surface 410'a is formed as shown in FIG. 9.

Figure 1:
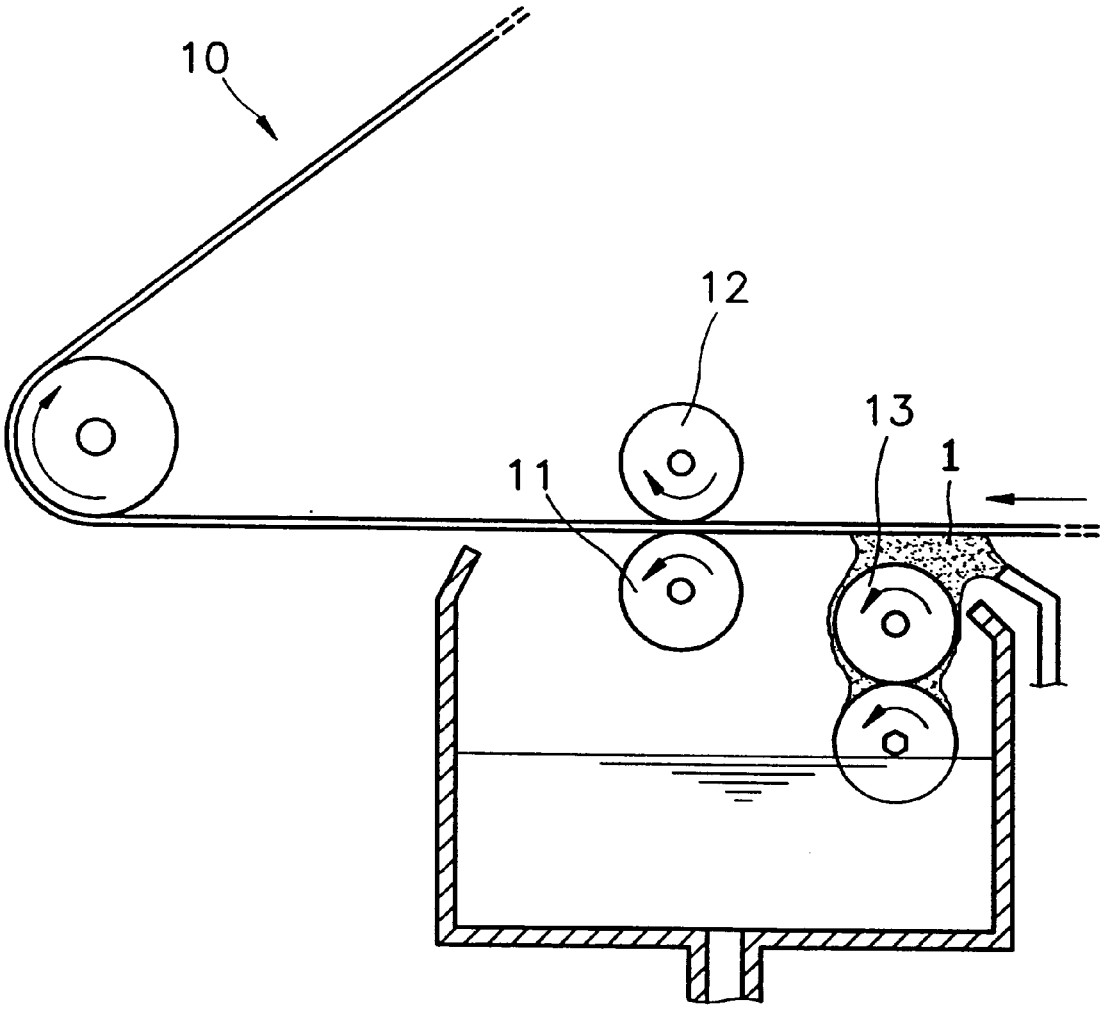
FIG.1(PRIOR ART)
FIG. 1 is a schematic view showing a developing unit of a general liquid electrophotographic printer.
Figure 2:
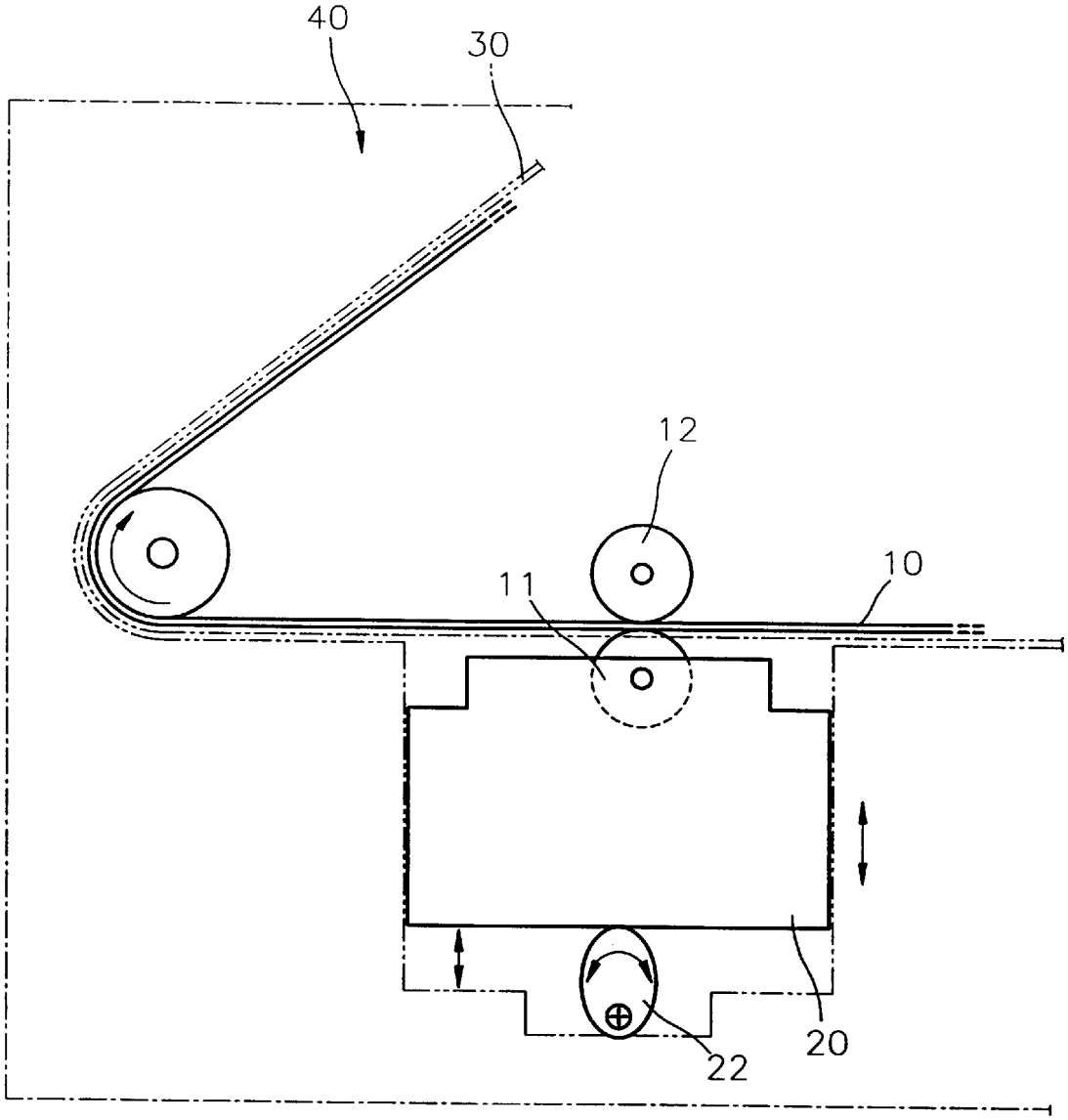
FIG.2(PRIOR ART)
FIG. 2 is a schematic view showing a conventional squeeze roller elevating apparatus.

As described above, according to the squeeze roller elevating apparatus of the present invention, since the print mode, the "drip-line" mode, and the stand-by mode are performed as the squeeze roller 110 installed at the squeeze frame 200 is elevated, a reactionary force generated when the photoreceptor belt 100 is pressed can be prevented from being transferred to the main frame 40 of FIG. 2.

It is contemplated that numerous modifications may be made to the squeeze roller elevating apparatus of the present invention without departing from the spirit and scope of the invention as defined in the following claims.

What is claimed is:

1. A squeeze roller elevating apparatus of a liquid electrophotographic printer for selectively pressing a photoreceptor belt, which is installed at a belt frame for circulation, by elevating a squeeze roller, said apparatus comprising:

a housing fixed at the belt frame;

a squeeze frame installed in said housing and operative to elevatingly support the squeeze roller;

a first elevating member installed at said squeeze frame for elevating movement;

a second elevating member installed at said squeeze frame for elevating movement by being interlocked with the elevating movement of said first elevating member and moving said squeeze frame upward so that the squeeze roller presses the photoreceptor belt while ascending;

a first spring coupling said first elevating member and said second elevating member to be interlocked with one another;

a second spring coupling said second elevating member and said squeeze frame to be interlocked with one another; and an elevator which elevates said first elevating member.

2. The apparatus as claimed in claim 1, wherein said elevator comprises:

a driving motor;

a cam member having a cam groove formed therein and rotated by said driving motor, which is installed at a shaft extended from said belt frame to pass through the inside of said housing; and a cam protrusion formed at said first elevating member and slidably inserted in said cam.

* * * * *